US011430619B2

(12) United States Patent
Liu et al.

(10) Patent No.: US 11,430,619 B2
(45) Date of Patent: Aug. 30, 2022

(54) KEY MODULE AND KEYBOARD

(71) Applicant: WISTRON CORP., New Taipei (TW)

(72) Inventors: Yuyin Liu, New Taipei (TW); Zhuhua Lu, New Taipei (TW); Minghui Xu, New Taipei (TW); Ximing Liang, New Taipei (TW); Guoqun Su, New Taipei (TW); Jiaqi Chen, New Taipei (TW)

(73) Assignee: WISTRON CORP., New Taipei (TW)

( * ) Notice: Subject to any disclaimer, the term of this patent is extended or adjusted under 35 U.S.C. 154(b) by 0 days.

(21) Appl. No.: 17/189,297

(22) Filed: Mar. 2, 2021

(65) Prior Publication Data

US 2022/0165519 A1 May 26, 2022

(30) Foreign Application Priority Data

Nov. 23, 2020 (CN) ..... 202011321011.1

(51) Int. Cl.
*H01H 13/12* (2006.01)
*H01H 13/7065* (2006.01)

(52) U.S. Cl.
CPC ... *H01H 13/7065* (2013.01); *H01H 2231/002* (2013.01)

(58) Field of Classification Search
CPC ..... H01H 3/125; H01H 13/705; H01H 13/14; H01H 13/70; H01H 13/704;
(Continued)

(56) References Cited

U.S. PATENT DOCUMENTS 5,769,210 A * 6/1998 Tsai ..... H01H 3/125 200/344
8,779,308 B2 7/2014 Takemae et al.
(Continued)

FOREIGN PATENT DOCUMENTS

JP 2012182107 A 9/2012
JP 2013229262 A 11/2013
(Continued)

OTHER PUBLICATIONS

TW Office Action dated May 13, 2021 in Taiwan application (No. 109142350).
JP Office Action dated Jun. 28, 2022 in JP2021-095800.

*Primary Examiner* — Ahmed M Saeed
(74) *Attorney, Agent, or Firm* — McClure, Qualey & Rodack, LLP

(57) ABSTRACT

This disclosure relates to a key module including a base, a first pivotable frame, a second pivotable frame and a keycap. The base includes two assembly frames. Each of the assembly frames includes an engagement portion and two guide portions. The engagement portion is connected to and located between the guide portions. The first pivotable frame is engaged with the engagement portion by being guided by the guide portions of the assembly frames. The second pivotable frame is engaged with the engagement portion by being guided by the guide portions of the assembly frames. The keycap includes a press part, a first engagement part and a second engagement part. The first engagement part and the second engagement part are connected to the press part. The first pivotable frame is engaged with the first engagement part, and the second pivotable frame is engaged with the second engagement part.

20 Claims, 15 Drawing Sheets

(58) Field of Classification Search
CPC ..... H01H 13/7065; H01H 13/7006; H01H 13/7057; H01H 13/78; H01H 13/79; H01H 13/52; H01H 13/703; H01H 13/507
See application file for complete search history.

(56) References Cited

U.S. PATENT DOCUMENTS

| | | | | |
|---|---|---|---|---|
| 9,870,881 | B2 | 1/2018 | Nishino | |
| 10,509,482 | B1 | 12/2019 | Tsai et al. | |
| 2009/0078552 | A1* | 3/2009 | Takemae ..... | H01H 3/125 200/344 |
| 2012/0199458 | A1* | 8/2012 | Takemae ..... | H01H 13/14 200/5 A |

FOREIGN PATENT DOCUMENTS

| | | | |
|---|---|---|---|
| TW | I573159 | B | 3/2017 |
| TW | 202009959 | A | 3/2020 |

* cited by examiner

KEY MODULE AND KEYBOARD

CROSS-REFERENCE TO RELATED APPLICATIONS

This non-provisional application claims priority under 35 U.S.C. § 119(a) on patent Application No(s). 202011321011.1 filed in China, P.R.C. on Nov. 23, 2020, the entire contents of which are hereby incorporated by reference.

TECHNICAL FIELD

The present disclosure relates to a key module and a keyboard, more particularly to a key module and a keyboard that have a pivotable frame.

BACKGROUND

A keyboard is an input device which uses an arrangement of buttons or keys to allow users to enter letters, symbols, numbers, and other characters into a computer. This concept is also widely employed for computer control of consumer electronics and business equipment.

Recently, the majority of computer keyboards are scissor-switch keyboards, but a regular frame for scissor-switch keyboards is thick so as to provide an extra room for the long key travel of the scissor switches.

In specific, a typical scissor-switch has two crossing pieces that interlock in a scissor-like fashion and snap to a keycap at one side and two hooks of the base at the other side, such that the keycap is movable with respect to the keyboard base. Such a design of the scissor-switch causes a complicated and laborious assembly process. In addition, the hooks, made of metal, often cause damage to the interlocked pieces during the assembly process and thereby affecting the durability and the haptic feedback.

SUMMARY

The present disclosure provides a key module and a keyboard that have a configuration enabling a simple assembly process and ensuring required durability and the haptic feedback.

According to one aspect of the present disclosure, a key module includes a base, a first pivotable frame, a second pivotable frame and a keycap. The base includes two assembly frames. Each of the assembly frames includes an engagement portion and two guide portions. The engagement portion is connected to and located between the guide portions of each of the assembly frames. The first pivotable frame is engaged with the engagement portion by being guided by the guide portions of each of the assembly frames. The second pivotable frame is engaged with the engagement portion by being guided by the guide portions of each of the assembly frames. The keycap includes a press part, at least one first engagement part and at least one second engagement part. The at least one first engagement part and the at least one second engagement part are connected to the press part. The first pivotable frame is engaged with the at least one first engagement part, and the second pivotable frame is engaged with the at least one second engagement part.

According to another aspect of the present disclosure, a keyboard includes a casing and a plurality of key modules disposed on the casing. Each of the plurality of key modules includes a base, a first pivotable frame, a second pivotable frame and a keycap. The base includes two assembly frames.

Each of the assembly frames includes an engagement portion and two guide portions. The engagement portion is connected to and located between the guide portions of each of the assembly frames. The first pivotable frame is engaged with the engagement portion by being guided by the guide portions of each of the assembly frames. The second pivotable frame is engaged with the engagement portion by being guided by the guide portions of each of the assembly frames. The keycap includes a press part, at least one first engagement part and at least one second engagement part. The at least one first engagement part and the at least one second engagement part are connected to the press part. The first pivotable frame is engaged with the at least one first engagement part, and the second pivotable frame is engaged with the at least one second engagement part.

According to the key module and the keyboard discussed above, the cooperation of the pivotable frames and the guide portions allows a smooth placement of the pivotable frames into the assembly frames, thus preventing the pivotable frames from being scratched or damaged by the assembly frames, thereby ensuring a quality assembly process as well as durability and haptic feedback.

BRIEF DESCRIPTION OF THE DRAWINGS

The present disclosure will become more fully understood from the detailed description given hereinbelow and the accompanying drawings which are given by way of illustration only and thus are not intending to limit the present disclosure and wherein.

DETAILED DESCRIPTION

Figure 1:
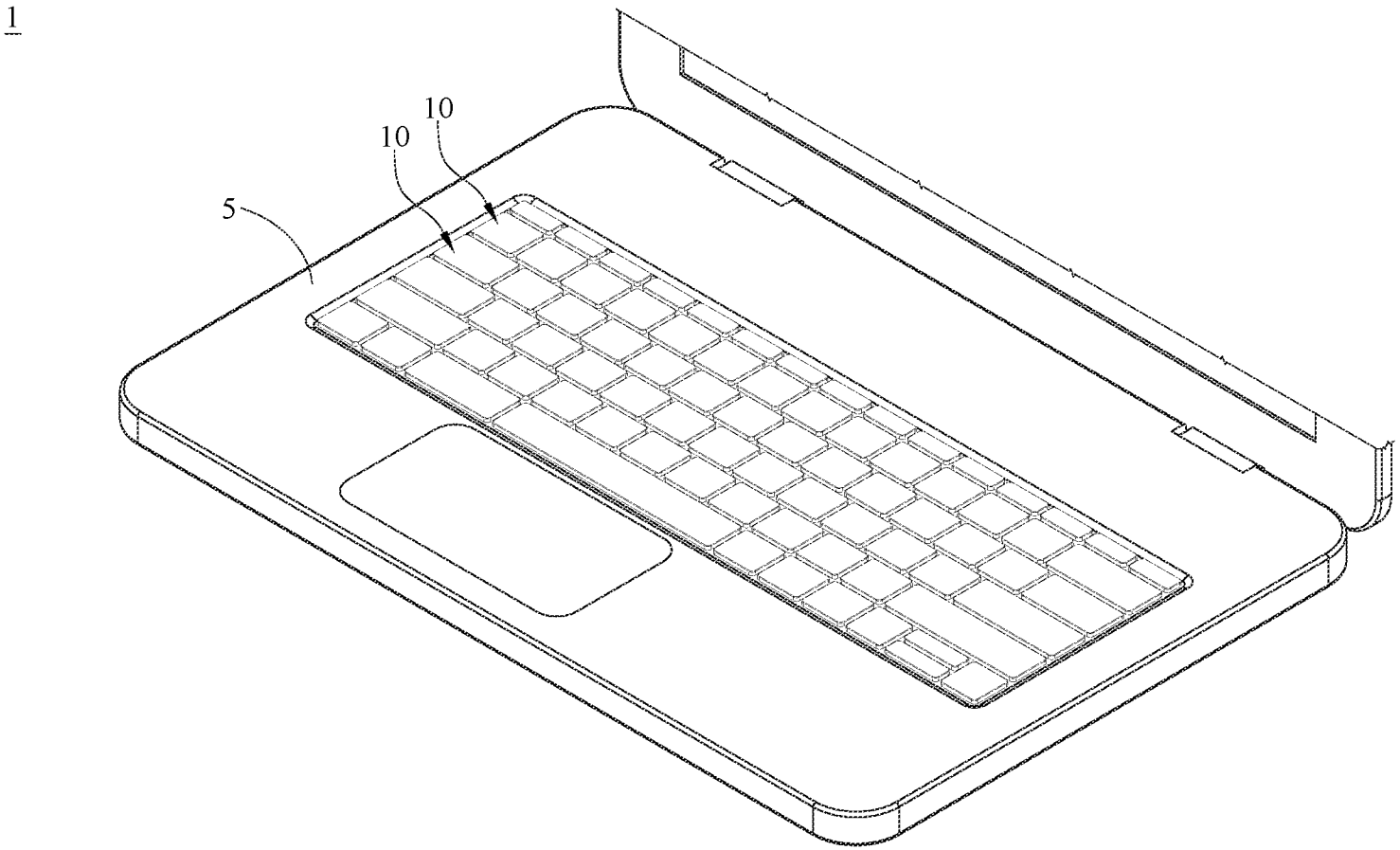
FIG. 1 is a perspective view of a keyboard according to a first embodiment of the present disclosure.

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

Figure 2:
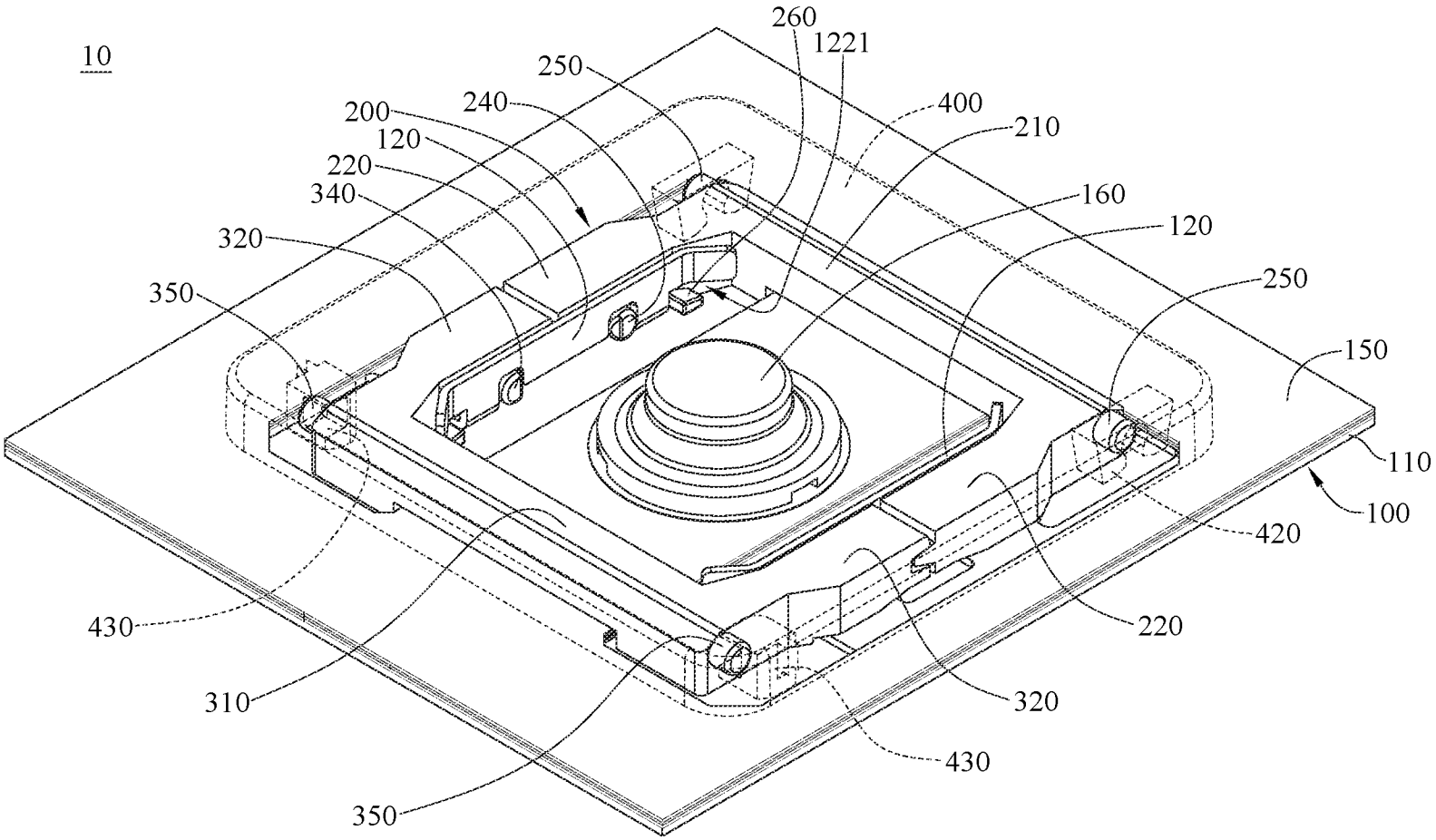
FIG. 2 is a perspective view of a key module of the keyboard in FIG. 1.
Figure 3:
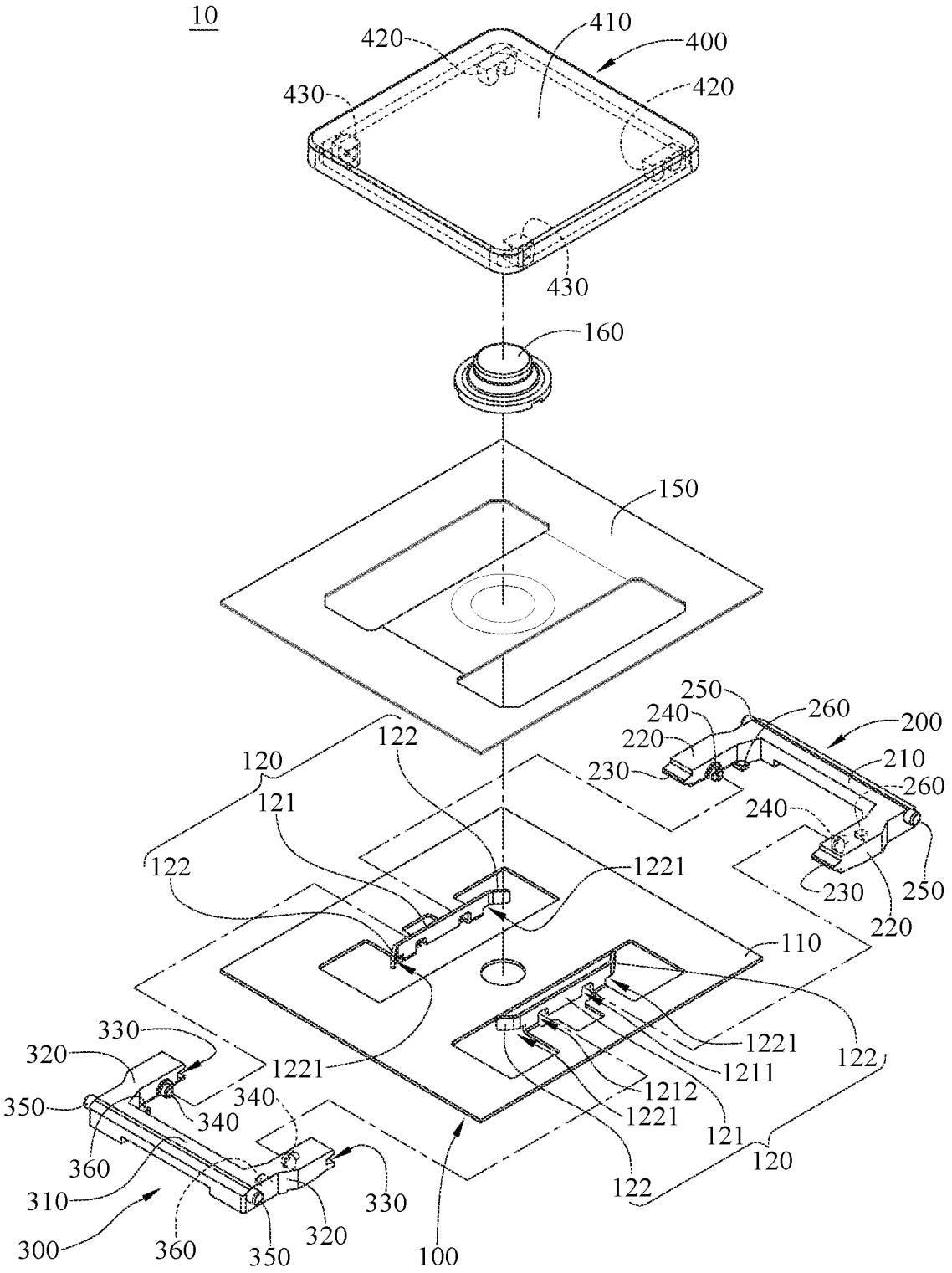
FIG. 3 is an exploded view of the key module in FIG. 2.
Figure 4:
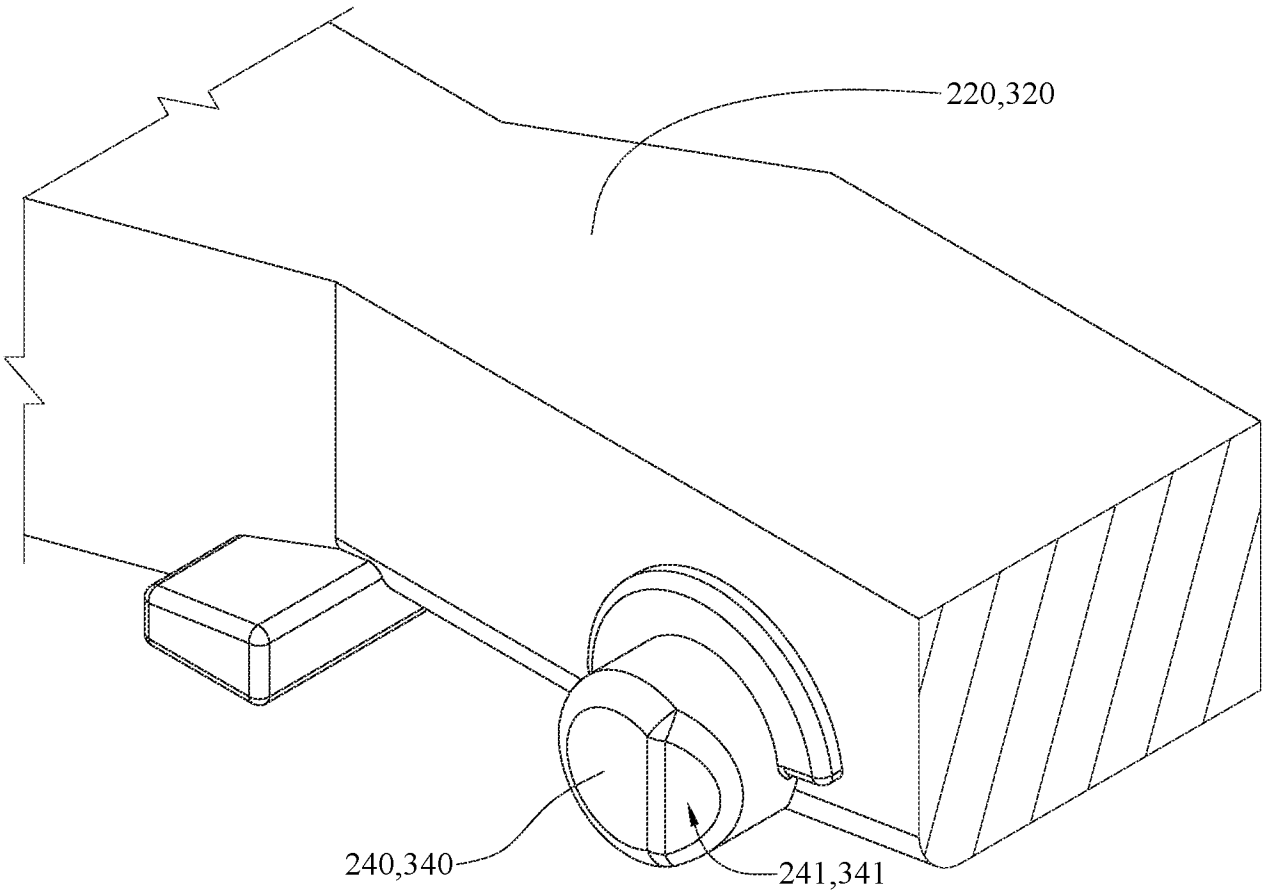
FIG. 4 is a partial enlarged view of a first pivotable frame and a second pivotable frame of the key module in FIG. 3.

Please refer to FIG. 1 to FIG. 4, where FIG. 1 is a perspective view of a keyboard according to a first embodiment of the present disclosure, FIG. 2 is a perspective view of a key module of the keyboard in FIG. 1, FIG. 3 is an exploded view of the key module in FIG. 2, and FIG. 4 is a partial enlarged view of a first pivotable frame and a second pivotable frame of the key module in FIG. 3.

As shown in FIG. 1, this embodiment provides a keyboard 1. The keyboard 1 is, for example, a build-in membrane keyboard of a notebook computer, but the present disclosure is not limited thereto. In some embodiments, the keyboard may be an external wireless or wired mechanical keyboard. The keyboard 1 includes a casing 5 and a plurality of key modules 10 installed on the casing 5.

As shown in FIG. 2 and FIG. 3, each of the key modules 10 includes a base 100, a first pivotable frame 200, a second pivotable frame 300, and a keycap 400.

The base 100 is made of, for example, metal. The base 100 includes a connection plate 110 and two assembly frames 120 formed by, for example, a stamping process. The connection plate 110 and the assembly frames 120 are connected to each other. Each assembly frame 120 includes an engagement portion 121 and two guide portions 122. The engagement portion 121 is connected to and located between the guide portions 122, and the engagement portion 121 is, for example, not parallel to the guide portions 122. In this embodiment, a distance between the guide portions 122 at the same side of different assembly frames 120 decreases from a side located close to the engagement portions 121 to a side located away from the engagement portions 121. That is, the distance between the guide portions 122 at the same side of different assembly frames 120 increases from the outer side to the central part of the assembly frames 120. As shown in FIG. 3, the guide portions 122 can be regarded as bent parts of the assembly frames 120, but the present disclosure is not limited thereto. In some other embodiments, the guide portions can be formed in smooth curved shapes with large radius. Alternatively, the guide portions can be formed by slightly decreasing the distance between ends of different assembly frames. The shapes of the guide portions can be adaptively changed depending on actual situations.

In this embodiment, each engagement portion 121 has a first engagement hole 1211 and a second engagement hole 1212. The guide portions 122 and the connection plate 110 are spaced apart from each other and form four positioning parts 1221 therebetween.

The first pivotable frame 200 includes a first support portion 210, two second support portions 220 and two first engagement protrusions 240. Similarly, the second pivotable frame 300 includes a first support portion 310, two second support portions 320 and two first engagement protrusions 340.

The first support portion 210 of the first pivotable frame 200 is connected to and located between the second support portions 220 of the first pivotable frame 200, and the second support portions 220 of the first pivotable frame 200 extend in the same direction. The first engagement protrusions 240 of the first pivotable frame 200 are respectively connected to sides of the second support portions 220 of the first pivotable frame 200 located away from the first support portion 210 of the first pivotable frame 200, and the first engagement protrusions 240 of the first pivotable frame 200 are respectively engaged with the first engagement holes 1211 by being guided by two of the guide portions 122 at the same side of different assembly frames 120. In detail, when the first engagement protrusions 240 of the first pivotable frame 200 move towards the engagement portions 121 from the two of the guide portions 122 at the same side of different assembly frames 120, the first engagement protrusions 240 of the first pivotable frame 200 are respectively abutted by the two guide portions 122 so as to slightly deform the second support portions 220 of the first pivotable frame 200 away from each other. When the first engagement protrusions 240 of the first pivotable frame 200 are aligned with the first engagement holes 1211, the first engagement protrusions 240 of the first pivotable frame 200 are respectively engaged with the first engagement holes 1211 due to the elasticity of the first support portion 210 and the second support portions 220. That is, a side of the first pivotable frame 200 is engaged with the engagement portions 121 by being guided by the guide portions 122 of the assembly frames 120.

The first support portion 310 of the second pivotable frame 300 is connected to and located between the second support portions 320 of the second pivotable frame 300, and the second support portions 320 of the second pivotable frame 300 extend in the same direction. The first engagement protrusions 340 of the second pivotable frame 300 are respectively connected to sides of the second support portions 320 of the second pivotable frame 300 located away from the first support portion 310 of the second pivotable frame 300, and the first engagement protrusions 340 of the second pivotable frame 300 are respectively engaged with the second engagement holes 1212 by being guided by another two of the guide portions 122 at the same side of the different assembly frames 120. In detail, when the first engagement protrusions 340 of the second pivotable frame 300 move towards the engagement portions 121 from the another two of the guide portions 122 at the same side of the different assembly frames 120, the first engagement protrusions 340 of the second pivotable frame 300 are respectively abutted by the another two guide portions 122 so as to slightly deform the second support portions 320 of the second pivotable frame 300 away from each other. When the first engagement protrusions 340 of the second pivotable frame 300 are aligned with the second engagement holes 1212, the first engagement protrusions 340 of the second pivotable frame 300 are respectively engaged with the second engagement holes 1212 due to the elasticity of the first support portion 310 and the second support portions 320. That is, a side of the second pivotable frame 300 is engaged with the engagement portions 121 by being guided by the guide portions 122 of the assembly frames 120.

As shown in FIG. 4, in this embodiment, the first engagement protrusions 240 each have an inclined surface 241, and the first engagement protrusions 340 each have an inclined surface 341. When the first engagement protrusions 240 of the first pivotable frame 200 move towards the engagement portions 121 from the two guide portions 122, the inclined surfaces 241 respectively movably abut the two guide portions 122. When the first engagement protrusions 340 of the second pivotable frame 300 move towards the engagement portions 121 from the another two guide portions 122, the inclined surfaces 341 respectively movably abut the another two guide portions 122.

In this embodiment, the inclined surfaces 241 and 341 of the first engagement protrusions 240 and 340 are exemplary and not intended to limit the present disclosure. In some other embodiments, the first engagement protrusions may not have the inclined surface in another embodiment, or only some of the first engagement protrusions have the inclined surface.

As shown in FIG. 2 and FIG. 3, in this embodiment, the first pivotable frame 200 may further include two first link structures 230 that are respectively connected to sides of the second support portions 220 of the first pivotable frame 200 located away from the first support portion 210 of the first pivotable frame 200. Similarly, the second pivotable frame 300 may further include two second link structures 330 that are respectively connected to sides of the second support portions 320 of the second pivotable frame 300 located away from the first support portion 310 of the second pivotable frame 300. The first link structures 230 are respectively movably coupled to the second link structures 330. The first link structures 230 of the present disclosure are, for example, gear tooth structures (e.g., teeth of a gear) extending towards outer sides of the second support portions 220 from inner sides of the second support portions 220 of the first pivotable frame 200. The second link structures 330 of the present disclosure are, for example, gear tooth spaces (e.g., space between two adjacent teeth of a gear) extending towards outer sides of the second support portions 320 from inner sides of the second support portions 320 of the second pivotable frame 300. The gear tooth structures are respectively meshed with the gear tooth spaces, such that the first pivotable frame 200 can be pivoted with respect to the second pivotable frame 300, and the first pivotable frame 200 and the second pivotable frame 300 can be pivoted with respect to the base 100. The abovementioned inner sides of the second support portions 220 refer to sides of the second support portions 220 facing each other, and the abovementioned outer sides of the second support portions 220 refer to sides of the second support portions 220 facing away from each other. Similarly, the abovementioned inner sides of the second support portions 320 refer to sides of the second support portions 320 facing each other, and the abovementioned outer sides of the second support portions 320 refer to sides of the second support portions 320 facing away from each other.

The first link structures 230 may be protrusion structures, the first link structures 230 of gear tooth structures in this embodiment are only an example of the protrusion structures, and the present disclosure is not limited thereto. The second link structures 330 may be recess structures, the second link structures 330 of gear tooth spaces in this embodiment are only an example of the recess structures, and the present disclosure is not limited thereto. Another examples would be described hereinafter.

In this embodiment, the first pivotable frame 200 may further include two positioning structures 260 connected to a side of the second support portions 220 located close to the first support portion 210 of the first pivotable frame 200. Similarly, the second pivotable frame 300 may further include two positioning structures 360 connected to a side of the second support portions 320 located close to the first support portion 310 of the second pivotable frame 300. When the first engagement protrusions 240 and 340 are engaged with the first engagement holes 1211 and the second engagements holes 1212, the positioning structures 260 and 360 are respectively movably located in the positioning parts 1221.

In this embodiment, the quantities of the positioning structures 260 and 360 are exemplary and are not intended to limit the present disclosure. In some other embodiments, each of the first pivotable frame and the second pivotable frame may only include one positioning structure or may include no positioning structure.

Figure 10:
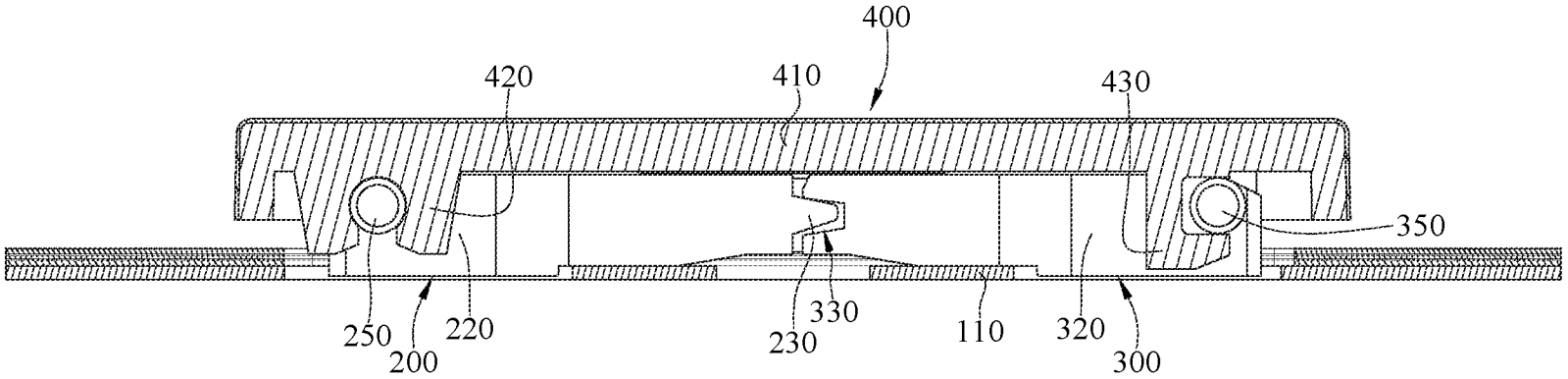
Figure 12:
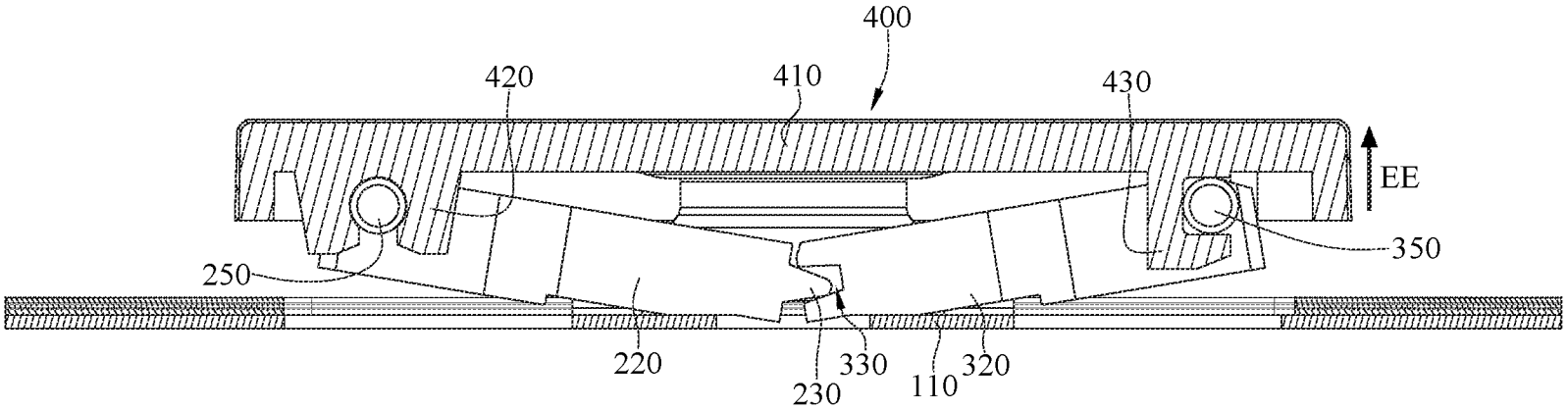
FIG. 12 is a cross-sectional view showing a keycap of the key module in FIG. 2 is at a lifted position.

The keycap 400 includes a press part 410, two first engagement parts 420 and two second engagement parts 430. The first engagement parts 420 and the second engagement parts 430 are connected to the same side of the press part 410. The first engagement parts 420 are close to the same side of the press part 410, and the second engagement parts 430 are close to the opposite side of the press part 410. The first pivotable frame 200 may further include two second engagement protrusions 250 that are respectively connected to sides of the second support portions 220 of the first pivotable frame 200 located close to the first support portion 210 of the first pivotable frame 200. The second pivotable frame 300 may further include two second engagement protrusions 350 that are respectively connected to sides of the second support portions 320 of the second pivotable frame 300 located close to the first support portion 310 of the second pivotable frame 300. The second engagement protrusions 250 of the first pivotable frame 200 are respectively engaged with the first engagement parts 420 of the keycap 400, and the second engagement protrusions 350 of the second pivotable frame 300 are respectively engaged with the second engagement parts 430 of the keycap 400. As such, the keycap 400 can be positioned at a lifted position (as shown in FIG. 12) or at a pressed position (as shown in FIG. 10) through the movement of the first pivotable frame 200 and the second pivotable frame 300 with respect to the base 100.

In this embodiment, the first engagement parts 420 are, for example, slots, and the second engagement parts 430 are, for example, hooks. However, the present disclosure is not limited thereto. In some other embodiments, all the first engagement parts and the second engagement parts may be slots.

In this embodiment, the key module 10 may further include a circuit layer 150 and an elastic trigger component 160. The circuit layer 150 is stacked on the base 100. The elastic trigger component 160 is clamped between the circuit layer 150 and the press part 410 of the keycap 400. When the keycap 400 is positioned at the pressed position, the keycap 400 is configured to actuate the circuit layer 150, and the elastic trigger component 160 is configured to return the keycap 400 back to the lifted position from the pressed position so as to stop the actuation of the circuit layer 150.

Please refer to FIG. 5 to FIG. 10, which are schematic views showing installation processes of the key module in FIG. 2.

Figure 5:
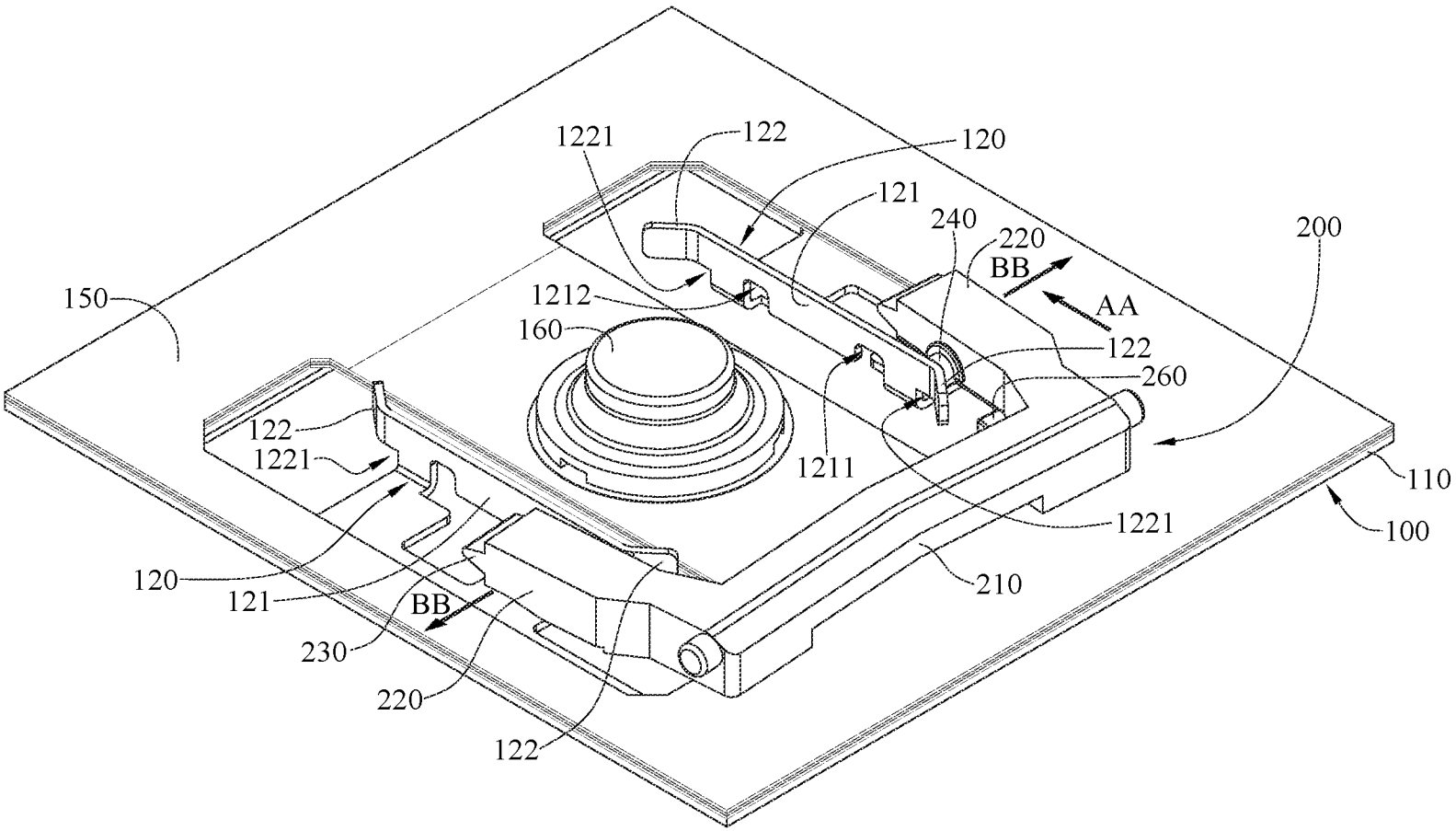
FIG. 5 to FIG. 10 are schematic views showing installation processes of the key module in FIG. 2.

As shown in FIG. 5, the first pivotable frame 200 is moved towards the engagement portions 121 of the assembly frames 120 in a direction AA. As discussed, the distance between two of the guide portions 122 at the same side of the different assembly frames 120 increases from the outer side to the central part of the assembly frames 120, thus the first engagement protrusions 240 of the first pivotable frame 200 is moved away from each other by the guide of the guide portions 122 of the assembly frames 120, thereby slightly deforming outwards the second support portions 220 with respect to the first support portions 210 in a direction BB.

Figure 6:
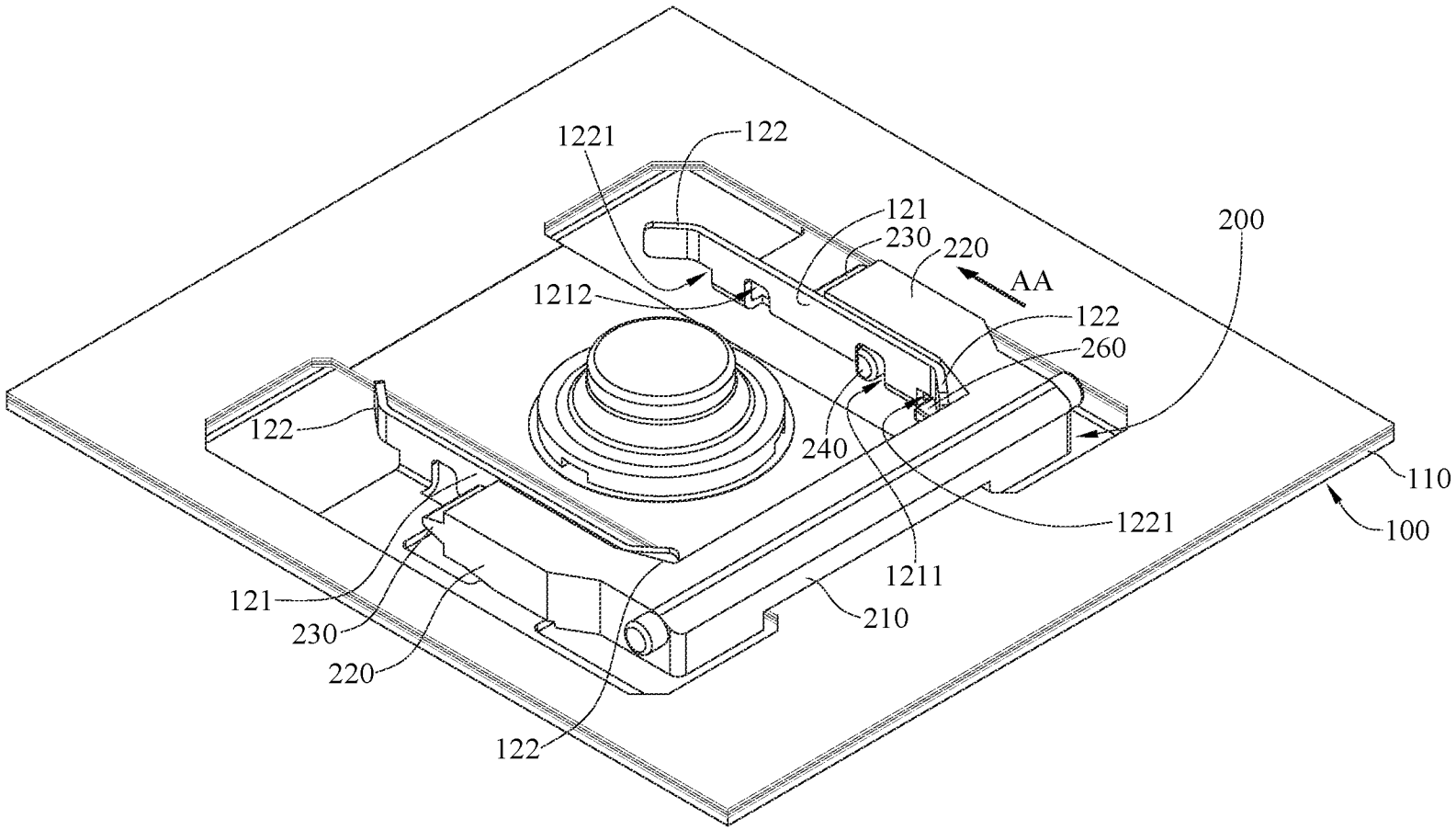

As shown in FIG. 6, the first pivotable frame 200 is kept moving towards the engagement portions 121 of the assembly frames 120 in the direction AA until the first engagement protrusions 240 of the first pivotable frame 200 are aligned with the first engagement holes 1211 of the engagement portions 121. At this moment, the first support portion 210 and the second support portions 220 recover to their original shapes so as to force the first engagement protrusions 240 of the first pivotable frame 200 to respectively engage with the first engagement holes 1211. By doing so, the first pivotable frame 200 is installed on the base 100.

During the process of moving the first pivotable frame 200 towards the engagement portions 121, the first engagement protrusions 240 of the first pivotable frame 200 are in contact with smooth surfaces of the engagement portions 121 and the guide portions 122, thus the base 100 does not scratch or cause any damage to the first engagement protrusions 240 of the first pivotable frame 200.

Figure 7:
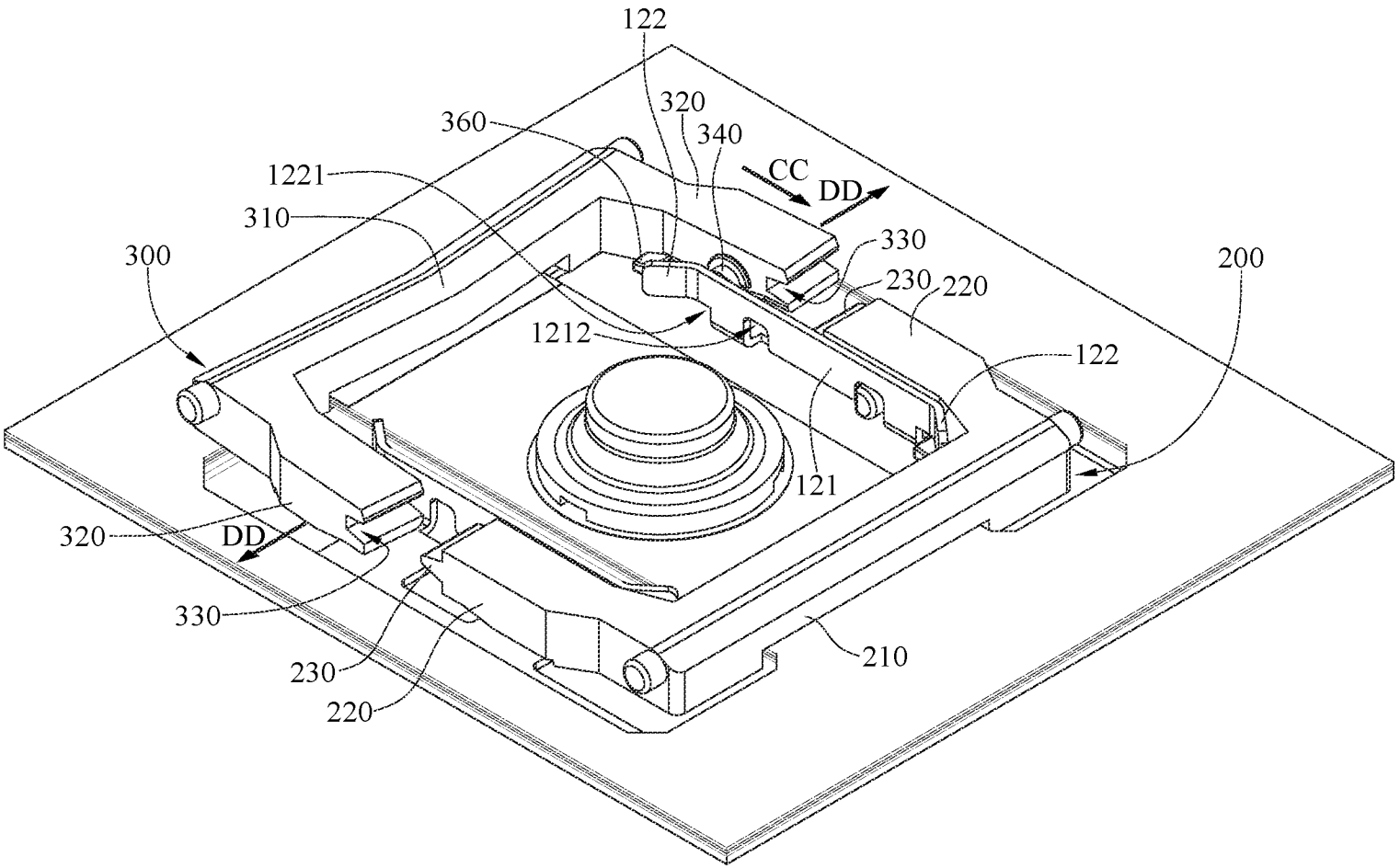

Then, as shown in FIG. 7, the second pivotable frame 300 is moved towards the engagement portions 121 of the assembly frames 120 in a direction CC. As discussed, the distance between the other two of the guide portions 122 at the same side of the different assembly frames 120 increases from the outer side to the central part of the assembly frames 120, thus the first engagement protrusions 340 of the second pivotable frame 300 is moved away from each other by the guide of the guide portions 122 of the assembly frames 120, thereby slightly deforming outwards the second support portions 320 with respect to the first support portions 310 in a direction DD.

Figure 8:
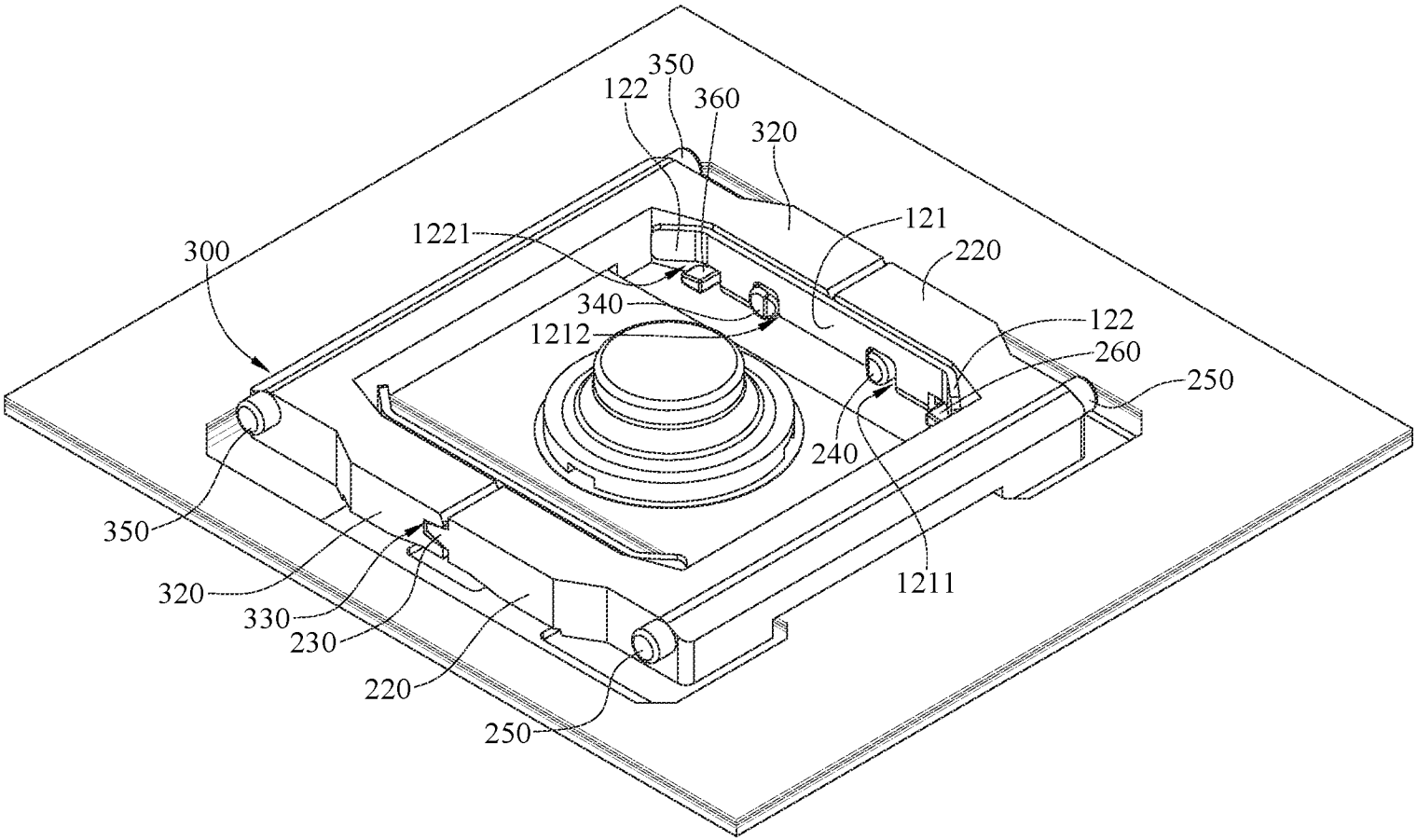

As shown in FIG. 8, the second pivotable frame 300 is kept on moving towards the engagement portions 121 of the assembly frames 120 in the direction CC until the first engagement protrusions 340 of the first pivotable frame 200 are aligned with the first engagement holes 1211 of the engagement portions 121. At this moment, the first support portion 310 and the second support portions 320 recover to their original shapes so as to force the first engagement protrusions 340 of the second pivotable frame 300 to respectively engage with the second engagement holes 1212. By doing so, the second pivotable frame 300 is installed on the base 100.

During the process of moving the second pivotable frame 300 towards the engagement portions 121, the first engagement protrusions 340 of the second pivotable frame 300 are in contact with smooth surfaces of the engagement portions 121 and the guide portions 122, thus the base 100 does not scratch or cause any damage to the first engagement protrusions 340 of the second pivotable frame 300.

Figure 9:
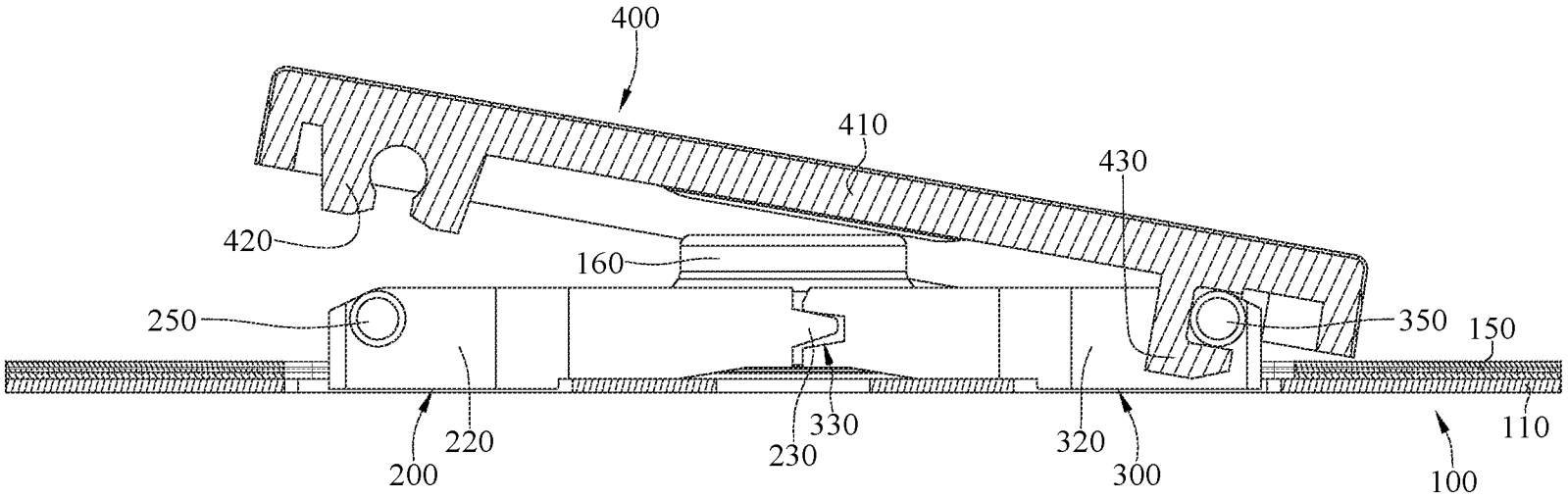

Then, as shown in FIG. 9, the second engagement parts 430 of the keycap 400 is engaged with the second engagement protrusions 350 of the second pivotable frame 300. Then, as shown in FIG. 10, the first engagement parts 420 of the keycap 400 is engaged with the second engagement protrusions 250 of the first pivotable frame 200. By doing so, the keycap 400 is installed on the first pivotable frame 200 and the second pivotable frame 300.

Figure 11:
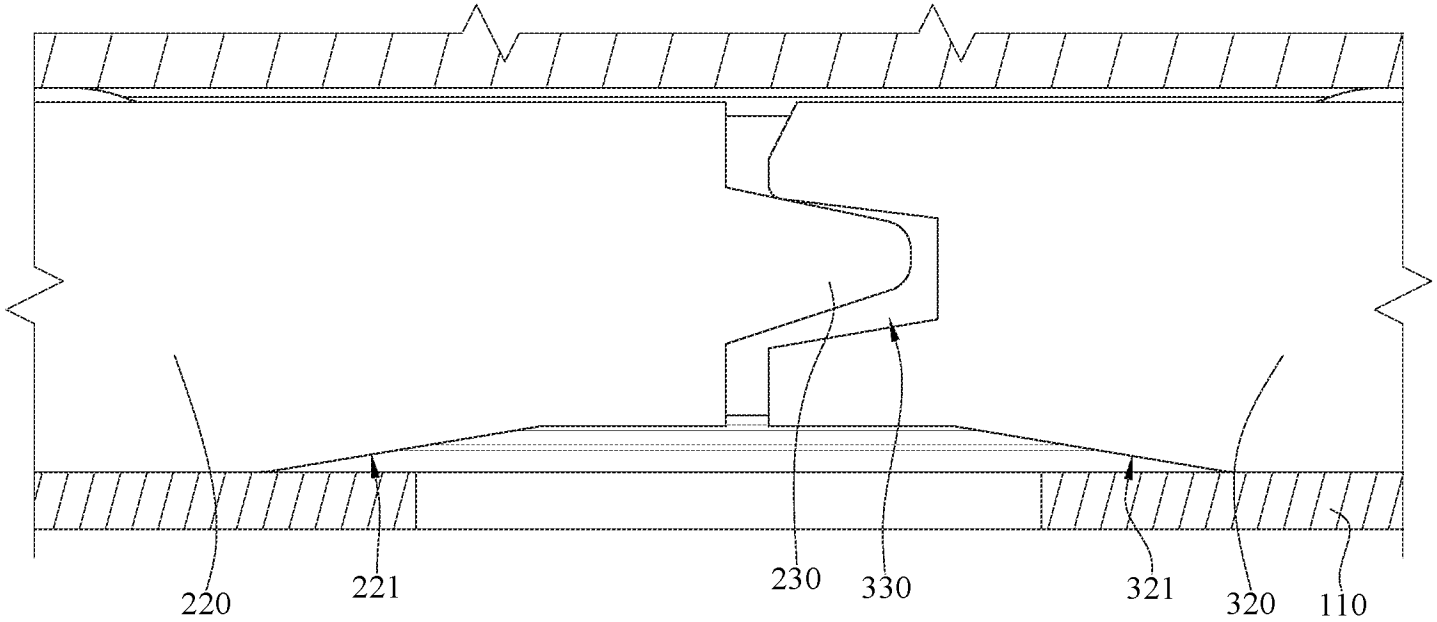
FIG. 11 is a partial enlarged view of the key module in FIG. 10.
Figure 13:
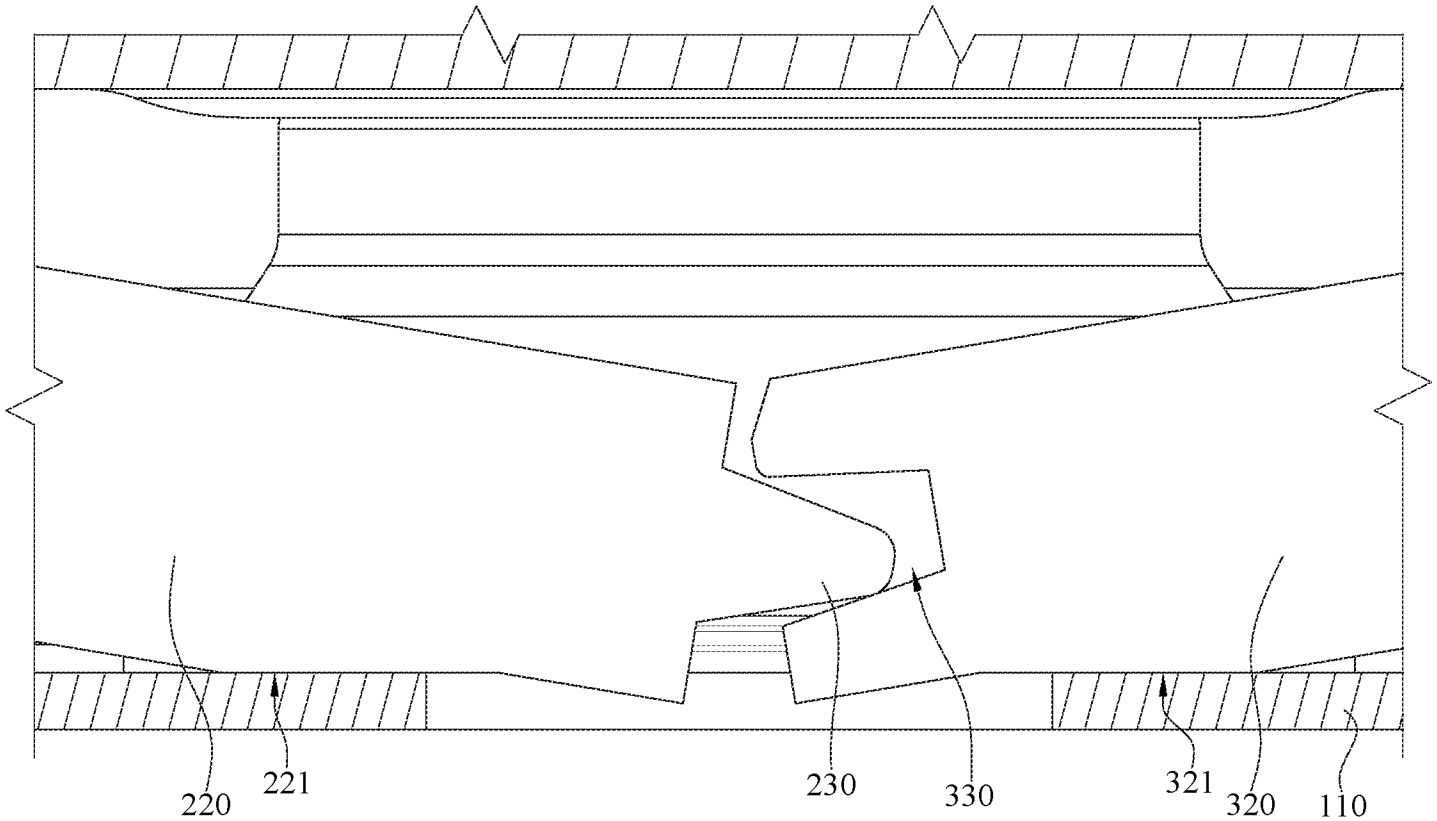
FIG. 13 is a partial enlarged view of the key module in FIG. 12.

Please refer to FIG. 10, and further refer to FIG. 11 to FIG. 13, where FIG. 11 is a partial enlarged view of the key module in FIG. 10, FIG. 12 is a cross-sectional view showing a keycap of the key module in FIG. 2 is at a lifted position, and FIG. 13 is a partial enlarged view of the key module in FIG. 12.

As shown in FIG. 10 and FIG. 11, the keycap 400 is positioned at the pressed position, and abutment surfaces 221 and 321 of the second support portions 220 and 320 are not yet in contact with the connection plate 110.

Then, as shown in FIG. 12 and FIG. 13, the keycap 400 moves in a direction EE to return to its original position, and the keycap 400 is positioned at the lifted position when abutment surfaces 221 and 321 of the second support portions 220 and 320 are parallel to and abut on the connection plate 110.

Figure 14:
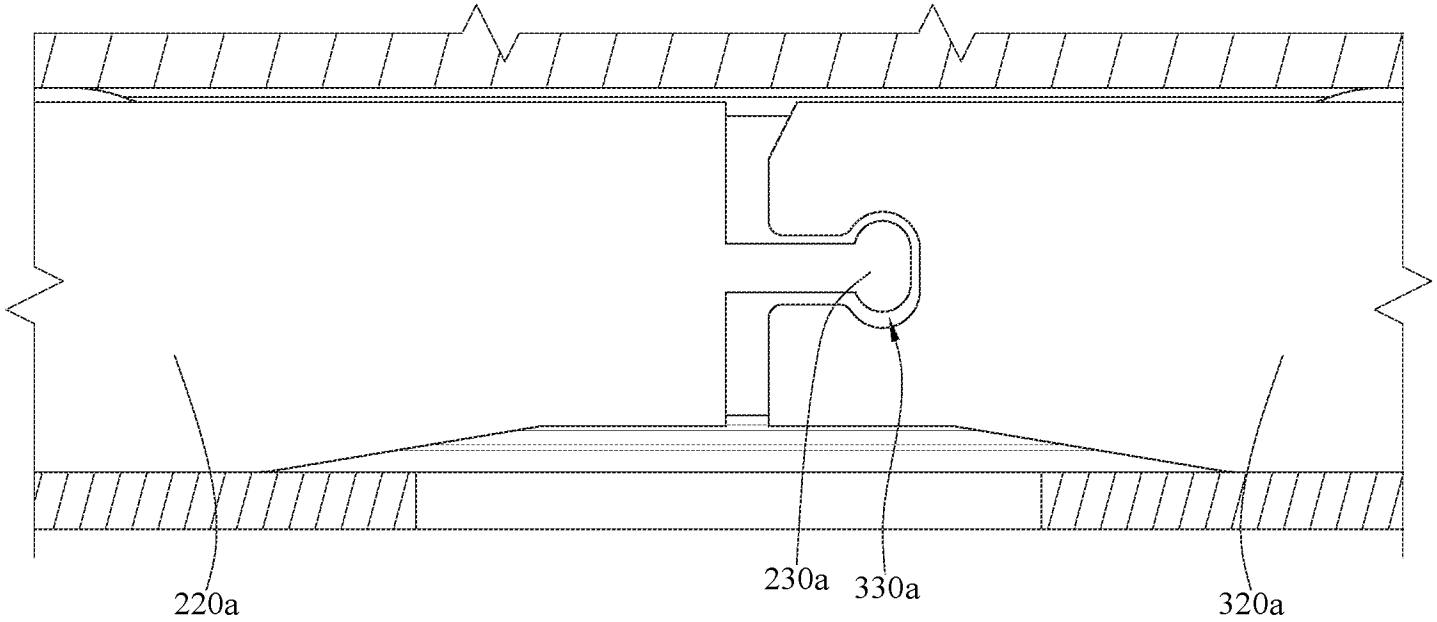
FIG. 14 is a partial enlarged view of a first pivotable frame and a second pivotable frame according to a second embodiment of the present disclosure.

In the abovementioned embodiments, the first link structures 230 of gear tooth structures and the second link structures 330 of gear tooth spaces are exemplary and can be modified as required. Please refer to FIG. 14, which is a partial enlarged view of a first pivotable frame and a second pivotable frame according to a second embodiment of the present disclosure.

In this embodiment, the first link structures 230*a* are post structures extending towards outer sides of the second support portions 220*a* from inner sides of the second support portions 220*a*, and the second link structures 330*a* are groove structures extending towards outer sides of the second support portions 320*a* from inner sides of the second support portions 320*a*.

Figure 15:
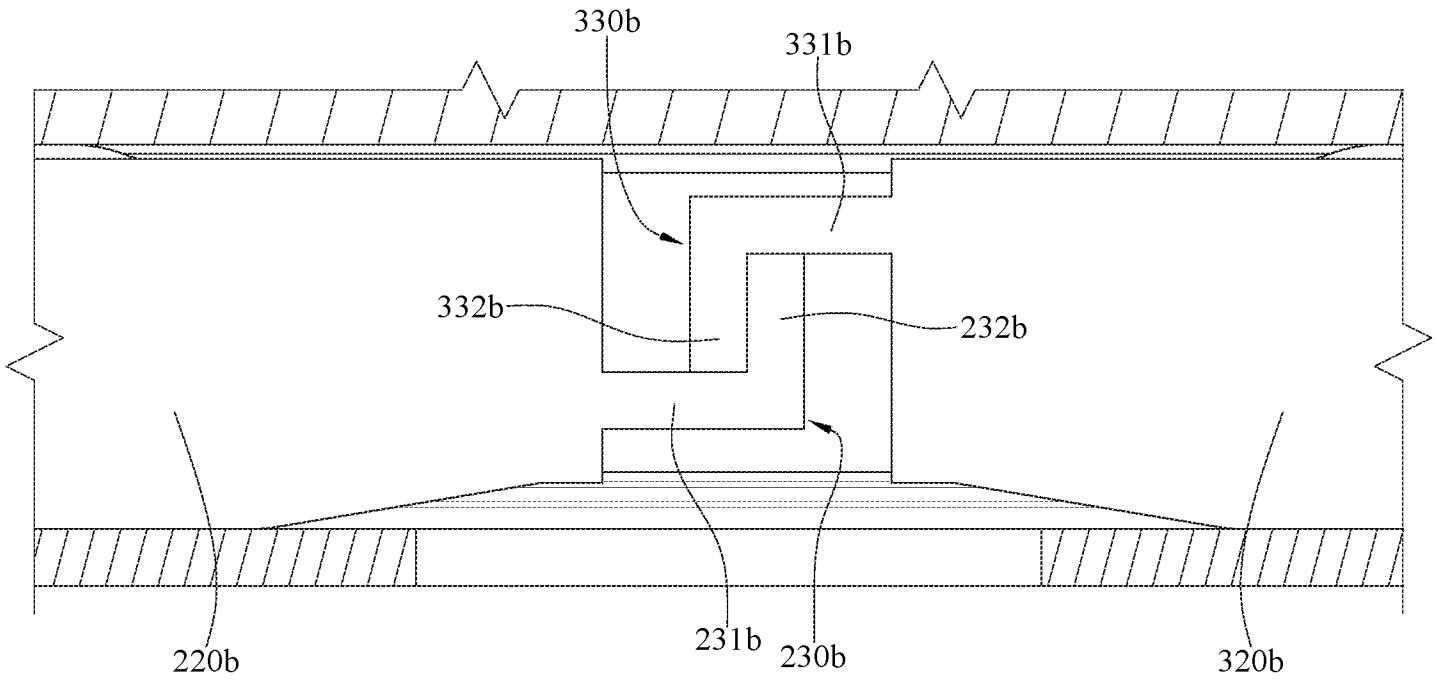
FIG. 15 is a partial enlarged view of a first pivotable frame and a second pivotable frame according to a third embodiment of the present disclosure.

Please further refer to FIG. 15, there is shown a partial enlarged view of a first pivotable frame and a second pivotable frame according to a third embodiment of the present disclosure.

In this embodiment, the first link structures 230*b* are first hook structures that each have a cross section in L shape, the first link structures 230*b* extend towards outer sides of the second support portions 220*b* from inner sides of the second support portions 220*b*, and the second link structures 330*b* are second hook structures that each have a cross section in L shape, and the second link structures 330*b* extend towards outer sides of the second support portions 320*b* from inner sides of the second support portions 320*b*. And the first hook structures are configured to be engaged with the second hook structures. In detail, each of the first link structures 230*b* includes a first extension portion 231*b* and a second extension portion 232*b*. The first extension portion 231*b* is connected to the second support portion 220*b*. The second extension portion 232*b* is connected to the first extension portion 231*b* and extends along a direction different from the extension direction of the first extension portion 231*b*. Each of the second link structures 330*b* includes a first extension portion 331*b* and a second extension portion 332*b*. The first extension portion 331*b* is connected to the second support portion 320*b*. The second extension portion 332*b* is connected to the first extension portion 331*b* and extends along a direction different from the extension direction of the first extension portion 331*b*, wherein the second extension portion 332*b* abuts on the second extension portion 232*b*.

According to the key module and the keyboard discussed above, the cooperation of the pivotable frames and the guide portions allows a smooth placement of the pivotable frames into the assembly frames, thus preventing the pivotable frames from being scratched or damaged by the assembly frames, thereby ensuring a quality assembly process as well as durability and haptic feedback.

Further, the first and second pivotable frames can be directly installed on the assembly frames of the base due to the guidance of the guide portions of the assembly frames, thereby enabling a simple assembly process and reducing steps involving in manufacturing the base (e.g., stamping processes) to help simplify the manufacturing process.

Furthermore, since the first link structures and the second link structures extend towards outer sides of the second support portions from inner sides of the second support portions, the first link structures and the second link structures substantially have the same width as the second support portions. As such, the first link structures and the second link structures can have relative large contact surfaces, thereby increasing the stability and the durability of the key module.

Furthermore, the mold for manufacturing the first and second pivotable frames can be in simple design since the first link structures and the second link structures extend towards outer sides of the second support portions from inner sides of the second support portions, thereby reducing the manufacturing cost of the mold.

Furthermore, according to the simple design mentioned above, the arrangement of the components of the key module can be further improved, thereby reducing the size of the key module.

Furthermore, the first engagement holes and the second engagement holes are full circles, such that the first engagement protrusions engaged with the first engagement holes and the second engagement holes would not be easily detached therefrom, and the key module can be firmly assembled.

The embodiments are chosen and described in order to best explain the principles of the present disclosure and its practical applications, to thereby enable others skilled in the art best utilize the present disclosure and various embodiments with various modifications as are suited to the particular use being contemplated. It is intended that the scope of the present disclosure is defined by the following claims and their equivalents.

What is claimed is:

1. A key module, comprising:

a base, comprising two assembly frames and a connection plate connected to the assembly frames, wherein each of the assembly frames comprises an engagement portion and two guide portions, the engagement portion is connected between the two guide portions of each of the assembly frames, the engagement portion has a first engagement hole and a second engagement hole, and the connection plate and each of the guide portions form a positioning part therebetween;

a first pivotable frame, engaged with the engagement portion through the guide portions of each of the assembly frames, wherein the first pivotable frame comprises two first engagement protrusions and at least one positioning structure, and the first engagement protrusions of the first pivotable frame are respectively engaged with the first engagement holes;

a second pivotable frame, engaged with the engagement portion through the guide portions of each of the assembly frames, wherein the second pivotable frame comprises two first engagement protrusions and at least one positioning structure, and the first engagement protrusions of the second pivotable frame are respectively engaged with the second engagement holes; and a keycap, comprising a press part, at least one first engagement part and at least one second engagement part, wherein the at least one first engagement part and the at least one second engagement part are connected to the press part, the first pivotable frame is connected to the at least one first engagement part, and the second pivotable frame is connected to the at least one second engagement part;

when the first engagement protrusions are engaged with the first engagement holes and the second engagement holes, the positioning structures of the first pivotable frame and the second pivotable frame are respectively movably disposed in the positioning parts formed between the connection plate and the first pivotable frame as well as the second pivotable frame.

2. The key module according to claim 1, wherein the first pivotable frame further comprises two first link structures that are respectively located at two sides of the first pivotable frame, the second pivotable frame further comprises two second link structures that are respectively located at two sides of the second pivotable frame, and the first link structures are respectively movably coupled to the second link structures.

3. The key module according to claim 1, wherein the first pivotable frame further comprises a first support portion and two second support portions, the first support portion is connected between the second support portions of the first pivotable frame, the second support portions of the first pivotable frame extend in a same direction, and the first engagement protrusions are respectively connected to sides of the second support portions.

4. The key module according to claim 3, wherein the second pivotable frame further comprises a first support portion and two second support portions, the first support portion is connected between the second support portions of the second pivotable frame, the second support portions of the second pivotable frame extend in a same direction, and the first engagement protrusions are respectively connected to sides of the second support portions.

5. The key module according to claim 4, wherein the first pivotable frame further comprises two first link structures that are respectively connected to sides of the second support portions of the first pivotable frame located away from the first support portion of the first pivotable frame, the second pivotable frame further comprises two second link structures that are respectively connected to sides of the second support portions of the second pivotable frame located away from the first support portion of the second pivotable frame, and the first link structures are respectively movably coupled to the second link structures.

6. The key module according to claim 5, wherein the first link structures are protrusion structures or post structures extending towards outer sides of the second support portions from inner sides of the second support portions of the first pivotable frame, and the second link structures are recess structures or groove structures extending towards outer sides of the second support portions from inner sides of the second support portions of the second pivotable frame.

7. The key module according to claim 5, wherein the first link structures are first hook structures extending towards outer sides of the second support portions from inner sides of the second support portions of the first pivotable frame, the second link structures are second hook structures extending towards outer sides of the second support portions from inner sides of the second support portions of the second pivotable frame, and the first hook structures are configured to be engaged with the second hook structures.

8. The key module according to claim 4, wherein each of the first engagement protrusions has an inclined surface; and when the first engagement protrusions of the first pivotable frame and the second pivotable frame move towards the engagement portions from the guide portions, the inclined surfaces respectively movably abut the guide portions.

9. The key module according to claim 4, wherein the first pivotable frame further comprises two second engagement protrusions that are respectively connected to sides of the second support portions of the first pivotable frame located close to the first support portion of the first pivotable frame, the second pivotable frame further comprises two second engagement protrusions that are respectively connected to sides of the second support portions of the second pivotable frame located close to the first support portion of the second pivotable frame, a quantity of the first engagement part is two, a quantity of the second engagement part is two, the second support portions of the first pivotable frame are respectively engaged with the first engagement parts of the keycap, and the second support portions of the second pivotable frame are respectively engaged with the second engagement parts of the keycap.

10. The key module according to claim 4, wherein the at least one positioning structure of the first pivotable frame is connected to a side of one of the second support portions located close to the first support portion of the first pivotable frame, and the at least one positioning structure of the second pivotable frame is connected to a side of one of the second support portions located close to the first support portion of the second pivotable frame.

11. The key module according to claim 10, wherein the connection plate is perpendicular to the assembly frames.

12. The key module according to claim 10, wherein each of the second support portions of the first pivotable frame and the second pivotable frame has an abutment surface; and when the abutment surfaces of the second support portions are parallel to and abut on the connection plate, the keycap is positioned at a lifted position.

13. The key module according to claim 1, further comprising a circuit layer and an elastic trigger component, wherein the circuit layer is stacked on the base, and the elastic trigger component is clamped between the circuit layer and the press part of the keycap.

14. The key module according to claim 1, wherein the first pivotable frame and the second pivotable frame are symmetrically disposed.

15. The key module according to claim 1, wherein a distance between the guide portions of different two of the assembly frames decreases from a side located close to the engagement portions to a side located away from the engagement portions.

16. The key module according to claim 5, wherein the first pivotable frame further comprises two second engagement protrusions that are respectively connected to sides of the second support portions of the first pivotable frame located close to the first support portion of the first pivotable frame, a quantity of the first engagement part is two, the second support portions of the first pivotable frame are respectively engaged with the first engagement parts of the keycap, the second pivotable frame further comprises two second engagement protrusions that are respectively connected to sides of the second support portions of the second pivotable frame located close to the first support portion of the second pivotable frame, a quantity of the second engagement part is two, the second support portions of the second pivotable frame are respectively engaged with the second engagement parts of the keycap, the first link structures are gear tooth structures, and the second link structures are gear tooth spaces.

17. A keyboard, comprising:

a casing; and a plurality of key modules, disposed on the casing, wherein each of the plurality of key modules comprises:

a base, comprising two assembly frames and a connection plate connected to the assembly frames, wherein each of the assembly frames comprises an engagement portion and two guide portions, the engagement portion is connected between the two guide portions of each of the assembly frames, the engagement portion has a first engagement hole and a second engagement hole, and the connection plate and each of the guide portions form a positioning part therebetween;

a first pivotable frame, engaged with the engagement portion through the guide portions of each of the assembly frames, wherein the first pivotable frame comprises two first engagement protrusions and at least one positioning structure, and the first engagement protrusions of the first pivotable frame are respectively engaged with the first engagement holes;

a second pivotable frame, engaged with the engagement portion through the guide portions of each of the assembly frames, wherein the second pivotable frame comprises two first engagement protrusions and at least one positioning structure, and the first engagement protrusions of the second pivotable frame are respectively engaged with the second engagement holes; and a keycap, comprising a press part, at least one first engagement part and at least one second engagement part, wherein the at least one first engagement part and the at least one second engagement part are connected to the press part, the first pivotable frame is connected to the at least one first engagement part, and the second pivotable frame is connected to the at least one second engagement part;

when the first engagement protrusions are engaged with the first engagement holes and the second engagement holes, the positioning structures of the first pivotable frame and the second pivotable frame are respectively movably disposed in the positioning parts formed between the connection plate and the first pivotable frame as well as the second pivotable frame.

18. The keyboard according to claim 17, wherein each of the first pivotable frame and the second pivotable frame comprises a first support portion and two second support portions, the first support portion is connected between the second support portions of each of the first pivotable frame and the second pivotable frame, the second support portions of each of the first pivotable frame and the second pivotable frame extend in a same direction, and the first engagement protrusions are respectively connected to sides of the second support portions located away from the first support portion of each of the first pivotable frame and the second pivotable frame.

19. The keyboard according to claim 18, wherein the first pivotable frame further comprises two first link structures that are respectively connected to sides of the second support portions of the first pivotable frame located away from the first support portion of the first pivotable frame, the second pivotable frame further comprises two second link structures that are respectively connected to sides of the second support portions of the second pivotable frame located away from the first support portion of the second pivotable frame, and the first link structures are respectively movably coupled to the second link structures.

20. The keyboard according to claim 19, wherein the first pivotable frame further comprises two second engagement protrusions that are respectively connected to sides of the second support portions of the first pivotable frame located close to the first support portion of the first pivotable frame, a quantity of the first engagement part is two, the second support portions of the first pivotable frame are respectively engaged with the first engagement parts of the keycap, the second pivotable frame further comprises two second engagement protrusions that are respectively connected to sides of the second support portions of the second pivotable frame located close to the first support portion of the second pivotable frame, a quantity of the second engagement part is two, the second support portions of the second pivotable frame are respectively engaged with the second engagement parts of the keycap, the first link structures are gear tooth structures extending towards outer sides of the second support portions from inner sides of the second support portions of the first pivotable frame, and the second link structures are gear tooth spaces extending towards outer sides of the second support portions from inner sides of the second support portions of the second pivotable frame.

* * * * *